United States Patent [19]

Opsvik

[11] Patent Number: 4,653,808

[45] Date of Patent: Mar. 31, 1987

[54] DEVICE FOR SUPPORTING A PERSON IN A SEATED POSITION

[76] Inventor: Peter Opsvik, Høgtunveien 12, N-1370 Asker, Norway

[21] Appl. No.: 690,653

[22] PCT Filed: Apr. 27, 1984

[86] PCT No.: PCT/NO84/00022

§ 371 Date: Dec. 21, 1984

§ 102(e) Date: Dec. 21, 1984

[87] PCT Pub. No.: WO84/04235

PCT Pub. Date: Nov. 8, 1984

[30] Foreign Application Priority Data

Apr. 29, 1983 [NO] Norway ..... 831536

[51] Int. Cl.[4] ..... A47C 7/50; A61H 3/04

[52] U.S. Cl. ..... 297/423; 297/4; 297/195; 135/67

[58] Field of Search ..... 135/65, 66, 67, 84, 135/85, 77, 68; 297/423, 424, 425, 426, 427, 438, 443, 444, 449, 4, 5, 6; 248/155, 155.1, 155.2, 155.3, 155.4, 155.5; D6/334, 335; 272/62, 63, 93, 116, 125, 126, 134, 144, 145

[56] References Cited

U.S. PATENT DOCUMENTS

| | | | |
|---|---|---|---|
| 200,441 | 2/1878 | Dormitzer | 182/57 X |
| 226,252 | 4/1880 | Smith et al. | 297/4 |
| 1,065,022 | 6/1913 | Bell | 297/195 |
| 1,283,168 | 10/1918 | Hart, Sr. | 297/423 |
| 2,099,345 | 11/1937 | Olszanowski | 297/4 |
| 2,282,689 | 5/1942 | Ames | 297/6 X |
| 2,387,451 | 10/1945 | Kuntz | 297/423 X |
| 2,530,544 | 11/1950 | Schwantes | 297/5 X |
| 2,656,875 | 10/1953 | Hutchinson | 297/4 |
| 2,745,465 | 5/1956 | Hogan | 135/67 X |
| 2,829,386 | 4/1958 | Peer | 297/4 UX |
| 3,306,658 | 2/1967 | Roberts | 297/4 |
| 3,350,095 | 10/1967 | Clasen | 297/6 X |
| 3,538,512 | 11/1970 | Dolan | 297/4 X |
| 3,643,938 | 2/1972 | Lavasseur | 128/75 X |
| 4,188,966 | 2/1980 | Palmer et al. | 135/67 |
| 4,328,991 | 5/1982 | Mengshoel et al. | 297/423 X |
| 4,451,080 | 5/1984 | Nix | 135/84 X |
| 4,526,422 | 7/1985 | Mengshoel et al. | 297/423 X |

FOREIGN PATENT DOCUMENTS

| | | | |
|---|---|---|---|
| 2518684 | 11/1975 | Fed. Rep. of Germany | 297/5 |
| 47812 | 12/1978 | Fed. Rep. of Germany | 272/144 |
| 911939 | 4/1946 | France | 272/144 |
| 125770 | 8/1949 | Sweden | 297/4 |
| 343087 | 1/1960 | Switzerland | 297/4 |
| 48201 | 1/1982 | U.S.S.R. | 272/145 |

*Primary Examiner*—Robert A. Hafer
*Assistant Examiner*—Arnold W. Kramer
*Attorney, Agent, or Firm*—Darby & Darby

[57] ABSTRACT

A supporting device for a person, said device having a posterior supporting face (2) and thigh supporting members (5,6) designed to engage a front portion of the person's respective thighs. A leg (3) depends from the posterior supporting face (2) and is suitably, through a transition member (12), connected to a leg base (13) being provided with casters (14). An anti-tilting device (15) may be provided at the rear end of the base (13). Foot engaging projection (16) may be present to contact a floor upon downward pressure thereon. The supporting device provides a stable 3-points support for a person assuming a standing-like sitting position.

13 Claims, 17 Drawing Figures

DEVICE FOR SUPPORTING A PERSON IN A SEATED POSITION

The present invention relates to a supporting device for a person, said supporting device having a posterior supporting face and a leg depending therefrom. As a modification, the posterior supporting face may be connected to a leg base through at least one transition member and a leg depending therefrom. Such supporting devices have been known for a long time, and have e.g. been designed as a walking stick, where the handle of the stick has been divided into two parts and outwardly foldable in order to form support for the person's posterior. Further, the said supporting device has been known in connection with so-called milking stools where the supporting device is attached by means of straps to the person's body.

It is a common feature of the known devices that the support is relatively unstable, and that it is necessary to tension the leg muscles to a great extent in order to be able to provide a stable standing position. Further, there is also a certain risk that an incorrect inclination of the depending leg may cause the person to fall backwards because the leg then suddenly moves relative to the ground.

Further, the invention relates to a supporting device for a person, said supporting device having a posterior supporting face being pivotably connected to a wall. Such a supporting device is known inter alia from the so-called tip-up seats or jump seats found e.g. on public transport means, in theatres and cinemas, in auditoriums, taxis etc.

Such known tip-up seats have frequently a heavy-duty hinge mechanism which in addition is provided with a spring device in order to bring the seat back to the wall after use. It has therefore been desirable in certain cases to simplify such seats, simultaneously enabling the seats to be used for a somewhat more standing-like sitting posture.

The present invention therefore aims to solve these known problems in a simple manner, and the inventive supporting device is characterized by the features which appear from the attached patent claims.

With the present invention, it is primarily obtained that the posterior supporting face coacts with means located in front thereof and being so designed that they will engage a portion of the front of the person's respective thighs.

The present invention therefore avoids a supporting device where a person is inclined to slide off the posterior supporting face, and therefore will have to tension his leg muscles in order to remain on the seat. Further, with the prior art supporting device, it will tend to slide in a rearward direction away from the user, thereby also creating uncertainty when sitting down. Further, with the prior art devices, it is impossible to move with the supporting device or move it to another location without the aid of one or both hands. These advantages are entirely avoided by the present device.

Even with fully relaxed muscles in the legs, the present inventive device will prevent the person from sliding off the seat or feeling too large pressure from the seat (as known from the so-called "standing type chairs" having a seat of the bicycle type), simply due to the supporting face on the front of the thigh. Due to the fact that there is a supporting face both at the front and rear of the person, the person will always feel very safe.

When standing freely and upon sitting down, the knees move forward, the thigh contacts the thigh support and the seat is automatically shifted into position. Ordinary office and factory chairs for common sitting level have casters and turning means because the user will always need to be able to move and shift in direct connection with the chair. However, with existing supporting devices, this is not possible when carrying out work in a standing posture. The present supporting device, however, will automatically follow the user, and the user can walk freely about together with the supporting device without paying particular attention thereto.

Thus, the present invention provides for persons carrying out work in a standing posture or simply assuming an almost standing posture, a possibility to have relaxed muscles in the legs when required, be able to move about with the supporting device on the body, stand freely or rest as required without the aid of the hands and without paying particular attention thereto. In this connection, when sitting down on the supporting device, e.g. for carrying out work in an almost standing posture, the level of the elbow is shifted only a few centimeters between a standing and a resting position. Therefore, the present supporting device may readily be used by a person which presently is used to work in a standing posture without any support.

Further characteristic features of the invention will appear from the description below with reference to the attached drawings, illustrating, as an example, some embodiments.

Figure 1:
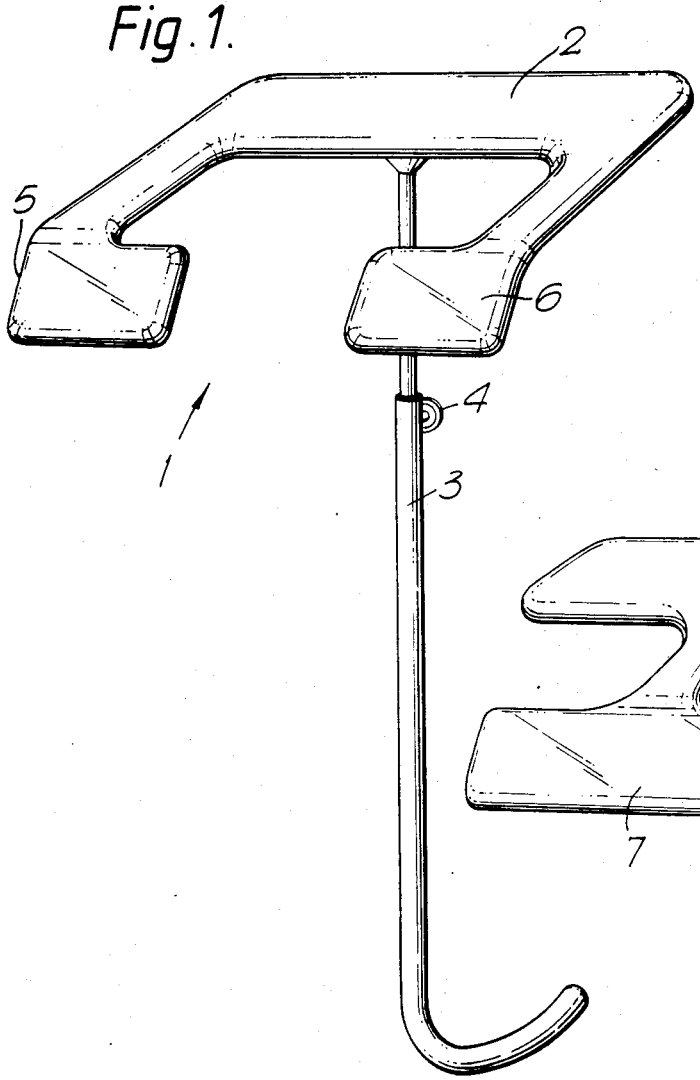
FIG. 1 is a first embodiment of the supporting device according to the invention.

In FIG. 1 there is illustrated a supporting device 1 having a posterior supporting face 2 and a leg 3 depending therefrom, which leg may be telescopically extendable in order to provide the posterior supporting face with the desired level by means of locking means 4, located on the leg 3. From the respective side portions of the posterior supporting face there extends forwardly two means, denoted 5 and 6, respectively, and being intended to engage a front portion of the respective thighs of the person, as will clearly appear from FIG. 3. In this manner, the said means 5, 6 will cause the leg 3 not to slide backwards independent of the posture which the person assumes with his knees. In this manner, there is obtained a much safer 3-point support for the person than that previously known.

Figure 2:
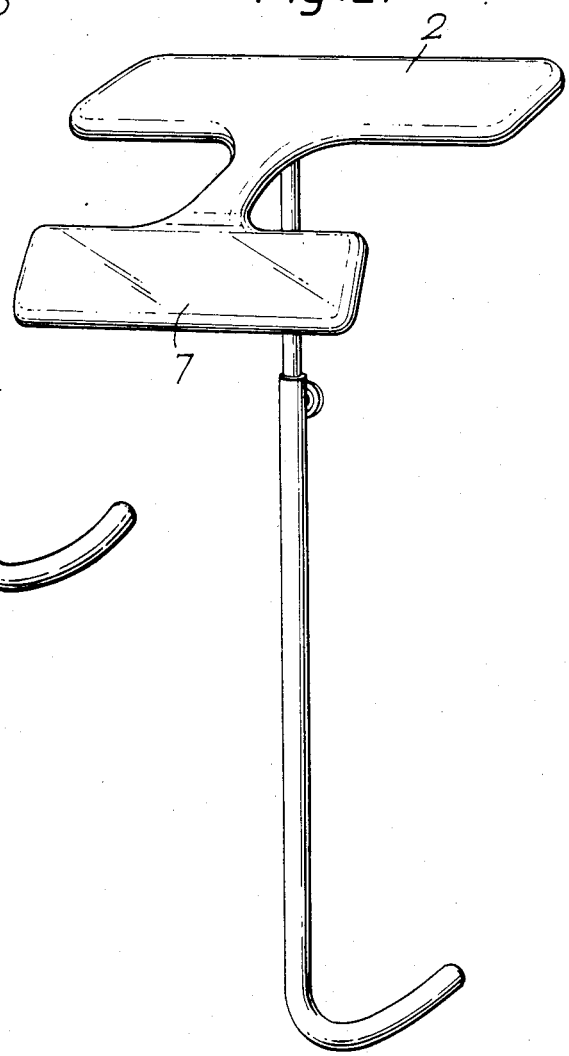
FIG. 2 is a second embodiment of the device according to the invention.
Figure 3:
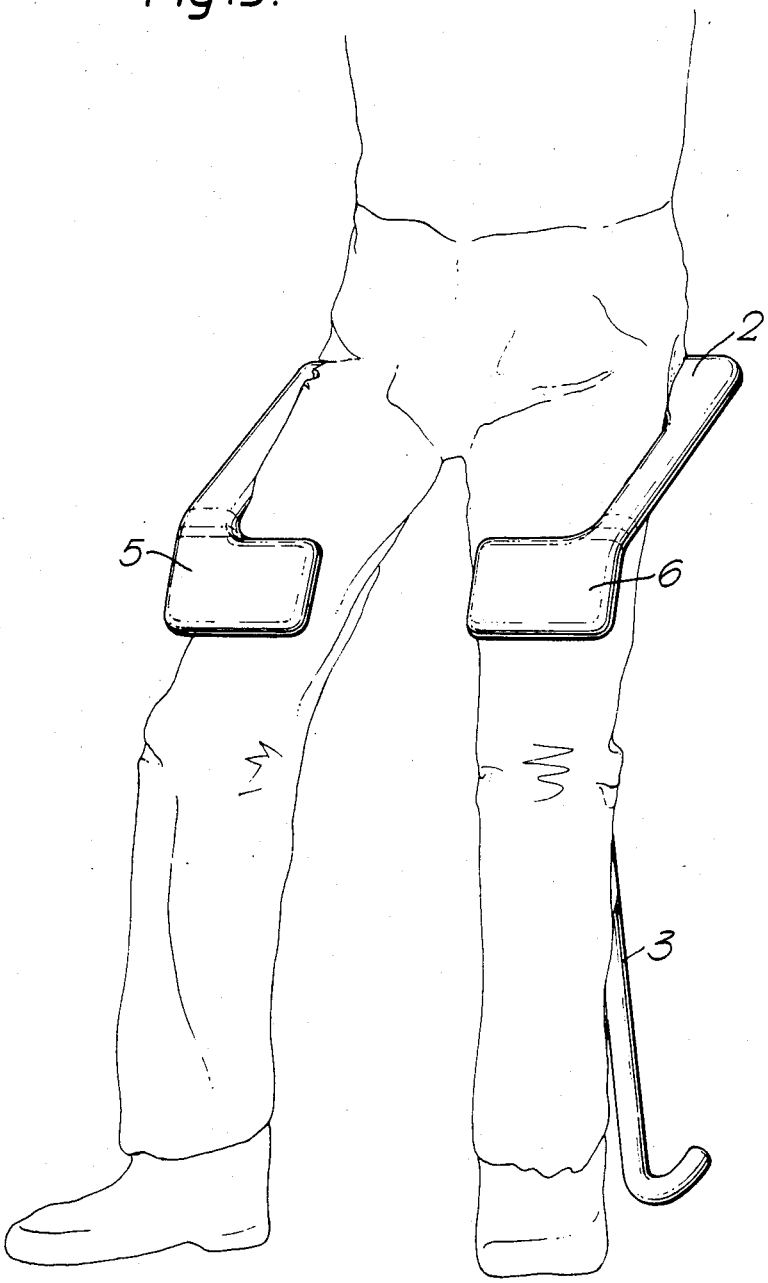
FIGS. 3 and 4 illustrate the utilization of the supporting device according to the invention.
Figure 4:
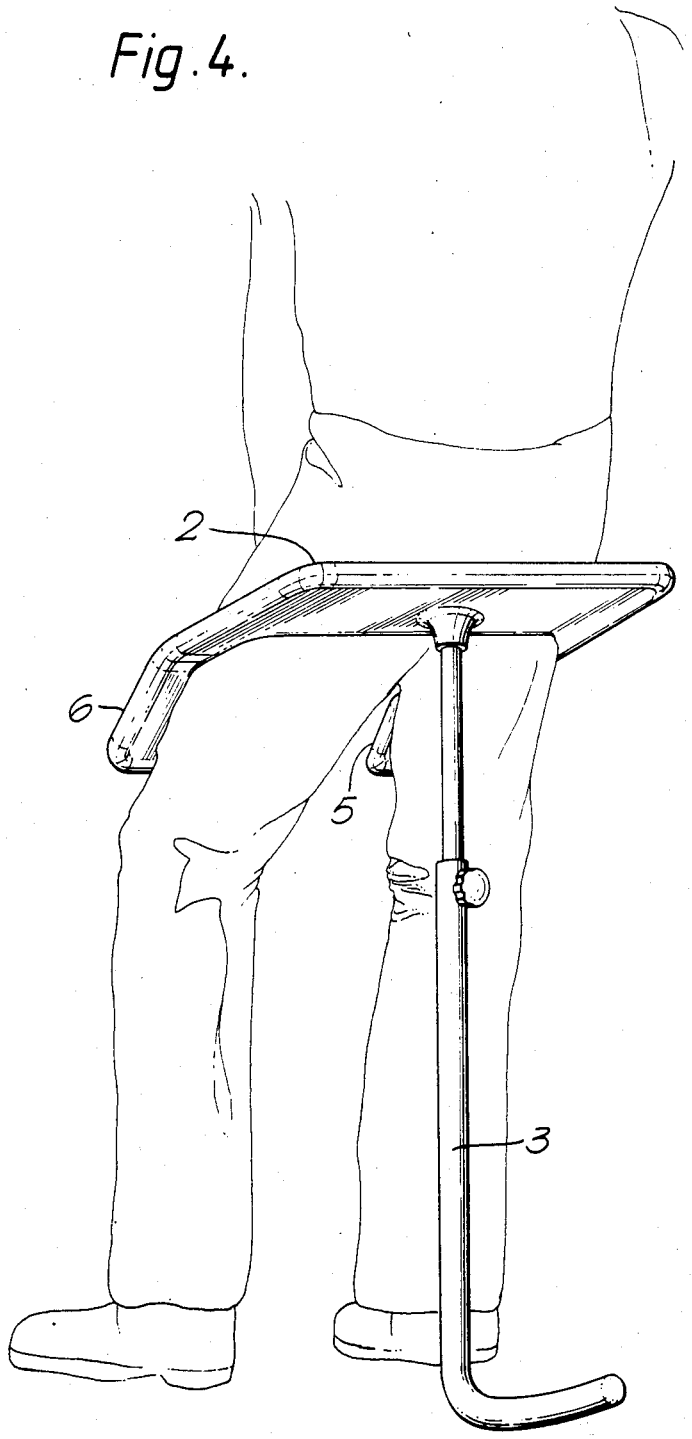

The embodiment shown in FIGS. 1, 3 and 4 will be suitable for person irrespective of the use of trousers or dress/skirt, whereas the supporting device in FIG. 2 is particularly suitable for persons using trousers or slacks.

The embodiment of FIG. 2 is different from the embodiment of FIG. 1 in that the said means are protruding centrally out from the front of the posterior supporting face 2, and at the front of said means there is provided a transverse part 7, the free branches of which are intended to engage the respective front portions of the person's thighs.

As will clearly appear from the drawings, the supporting leg 3 is at its lower end curved slightly upward. This is particularly advantageous in order to enable a more convenient shifting of the leg along the ground or a floor, until the 3-point support formed by the leg 3 and the legs of the user come to a stable state. It is readily understood that if the said means 5, 6; 7 had not been provided there would be present a great risk that the user would fall backward since the leg 3 could easily lose contact with the ground/floor. However, the said means 5, 6; 7 will provide a forwardly directed moment on the leg 3 and thereby prevent the leg 3 from inadvertently sliding backwards.

If required, the locking mechanism 4 can be made resilient or may be constituted e.g. by a spring influenced control mechanism or a lifting/lowering mechanism known per se, e.g. from office chairs.

Figure 5:
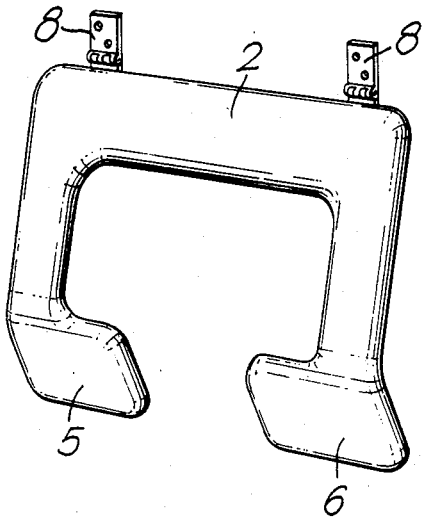
FIGS. 5 and 7 illustrate a third embodiment of the supporting device according to the invention, intended for a hinged connection to a wall.
Figure 7:
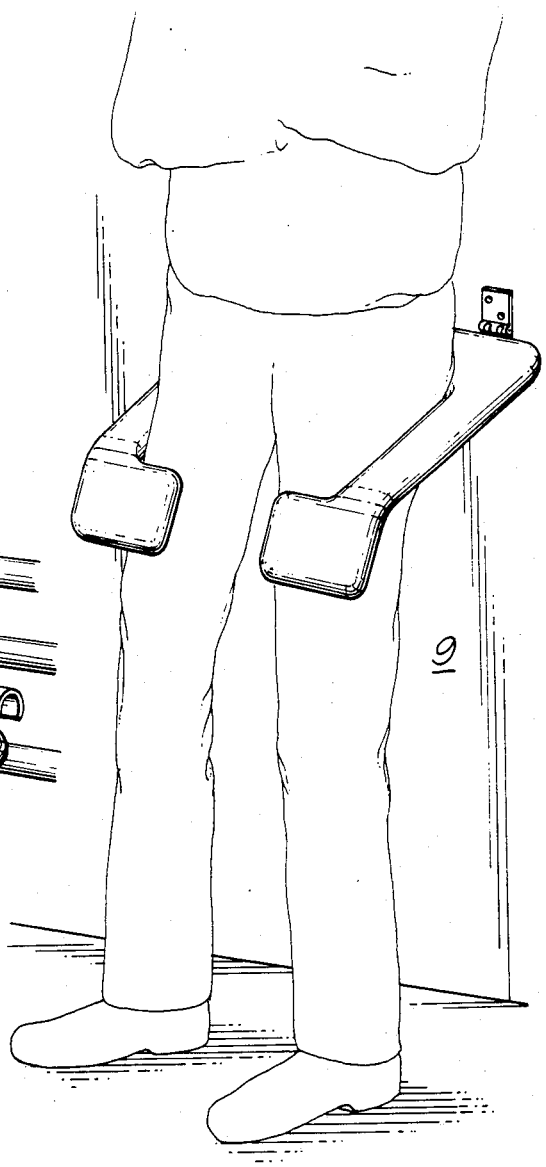

In FIGS. 5 and 7, the posterior supporting face 2 and the said means 5, 6 are intended to be hinged to a wall face 9 by means of hinges 8. In this manner cost increasing spring mechanisms are avoided simultaneously with the provision of a tip-down seat which may be connected to the wall by means of simple and non-complicated hinges. The device provides an excellent posterior support and by means of the said means 5, 6 a forward sliding is prevented, despite a relatively small posterior supporting face depth.

Figure 6:
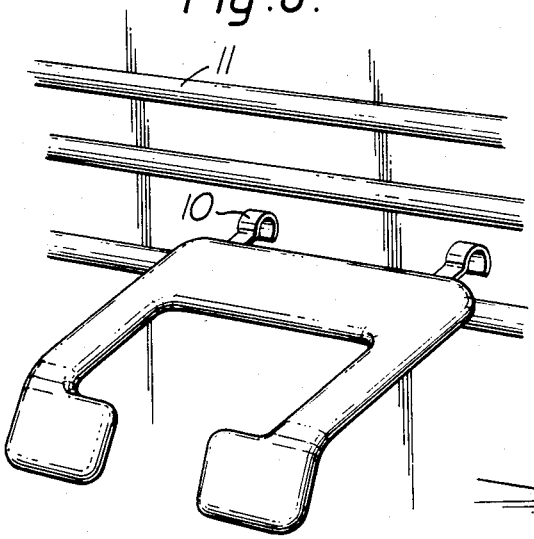
FIG. 6 is a fourth embodiment of the supporting device, representing a slight modification of the embodiment according to FIG. 5.

In a modified embodiment, the hinges may be in the form of hooks 10 as indicated in FIG. 6. The hooks may for example be located on longitudinally extending tubes 11 forming some sort of a wall or a partition wall, or possibly a so-called rib wall. Thereby it is made possible to adjust the level of the supporting device in a simple manner. As an alternative to the longitudinal tubes, there may of course be provided eye-hooks or simply reinforced holes in the wall face itself.

The devices in FIGS. 5 and 7 may of course have a design substantially as that shown in FIG. 2.

Figure 8:
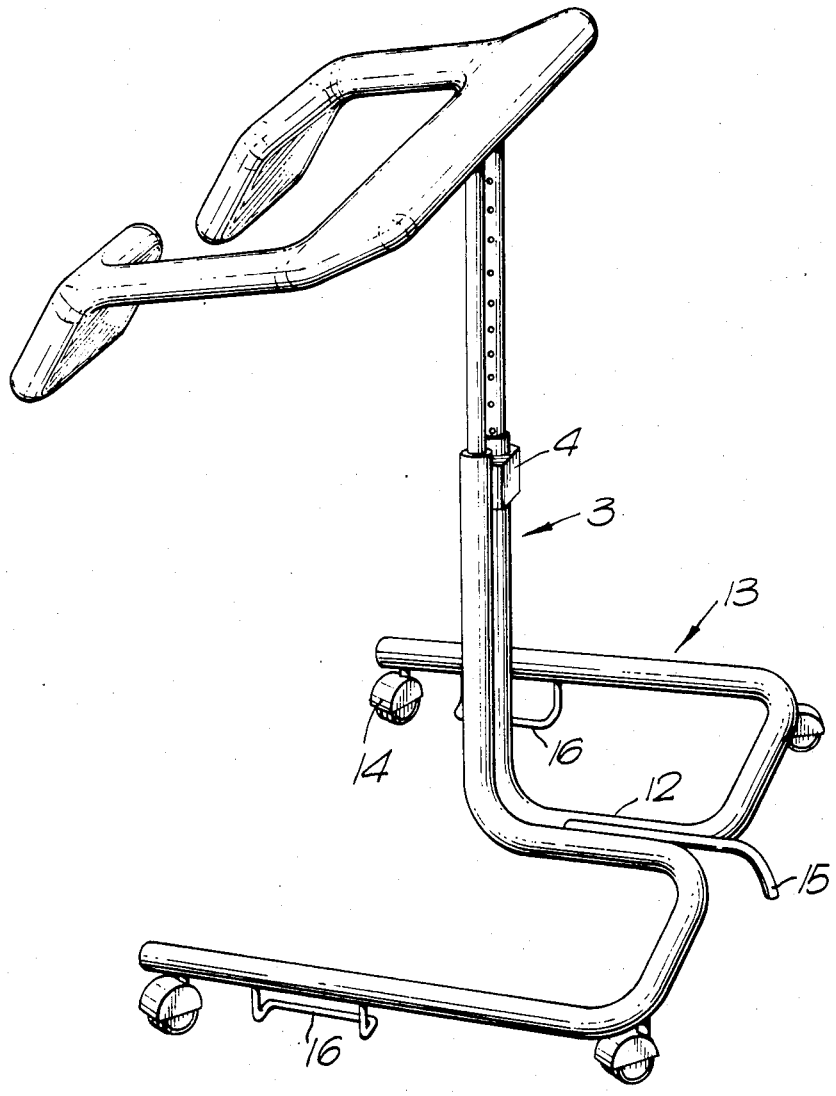
FIGS. 8, 9 and 10 illustrate a fifth embodiment of the supporting device representing a modification of the embodiment in FIGS. 1, 3 and 4.
Figure 9:
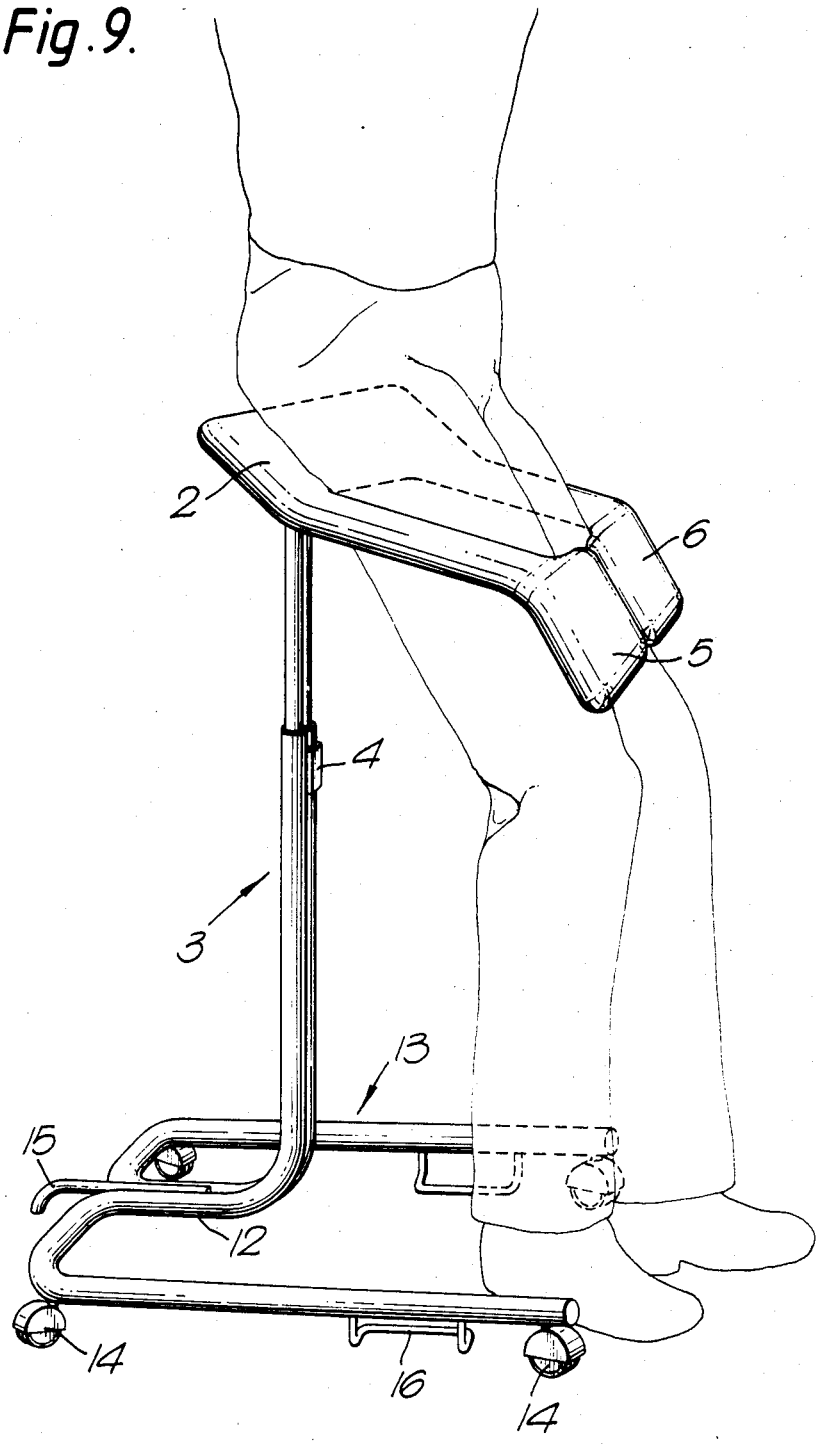
Figure 10:
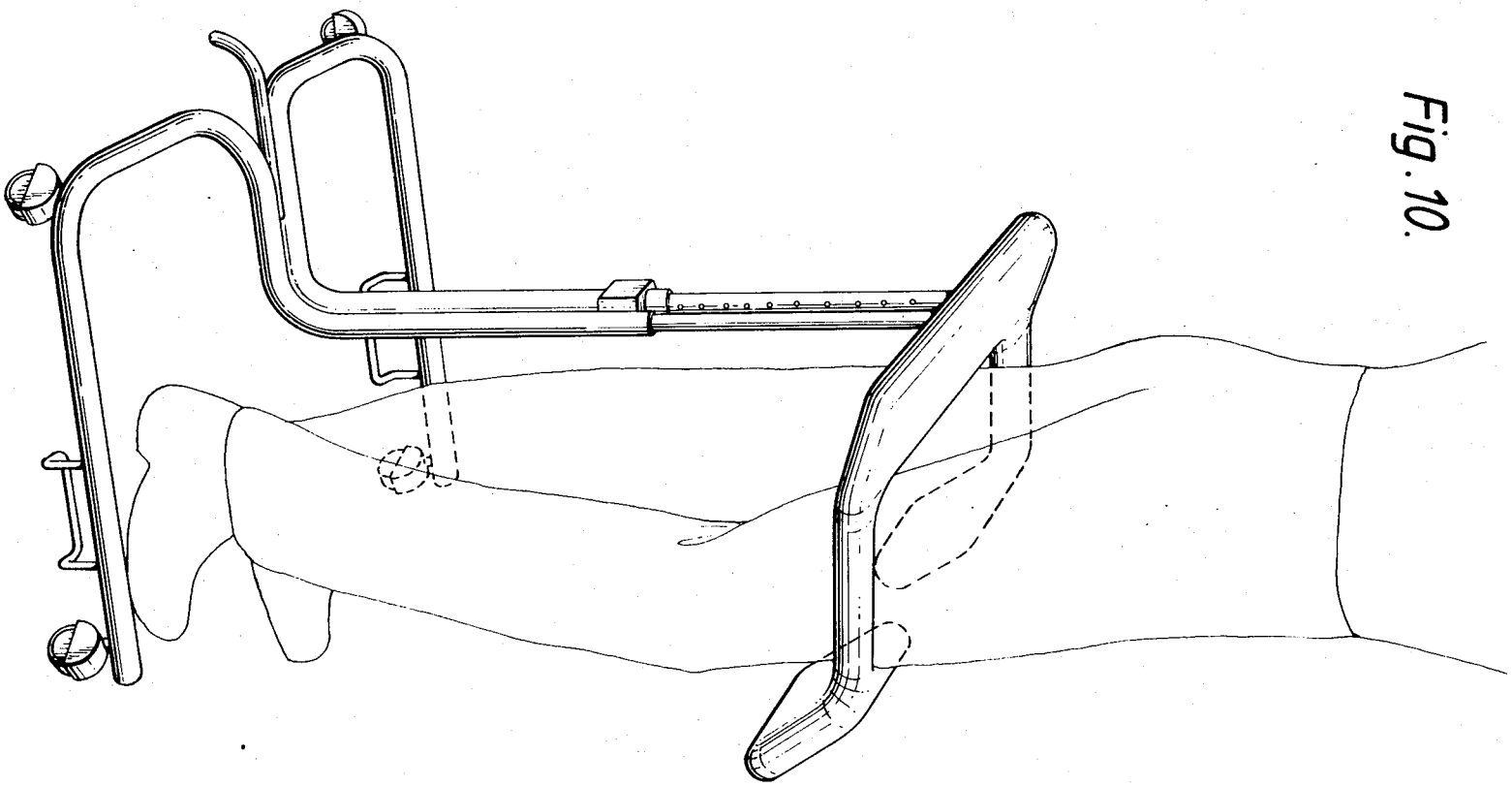

As will be seen from FIGS. 8, 9 and 10, the supporting device is quite similar to that shown in FIG. 1. However, it will be noted that the leg 3 at its bottom continues in a rearward directed portion 12 which continues into a leg base 13 having, in the example shown, four casters 14. In order to prevent the supporting device from overturning in a rearward direction, due to the rear casters, it is proposed according to the invention to arrange at least an anti-tilting device 15 at the rear of the said base 13, as clearly shown in FIG. 8. In order to make the overall construction as simple as possible, the leg 3 may be comprised of two telescopically operating tubes, one of which being provided with locking means 4, either for a step-free level adjustment as in FIG. 1 or a step adjustment as indicated as an example in FIG. 8.

When using the chair, as it is indicated in FIG. 10, i.e. when in a standing position, it is proposed to provide a foot engaging means 16 which upon the pressure from the feet either will engage the floor and thereby prevent the supporting device from moving, or cause the casters 14 to lock in position (not shown in detail).

In the remaining figures, those elements which have already been shown and described will not be described again.

Figure 11:
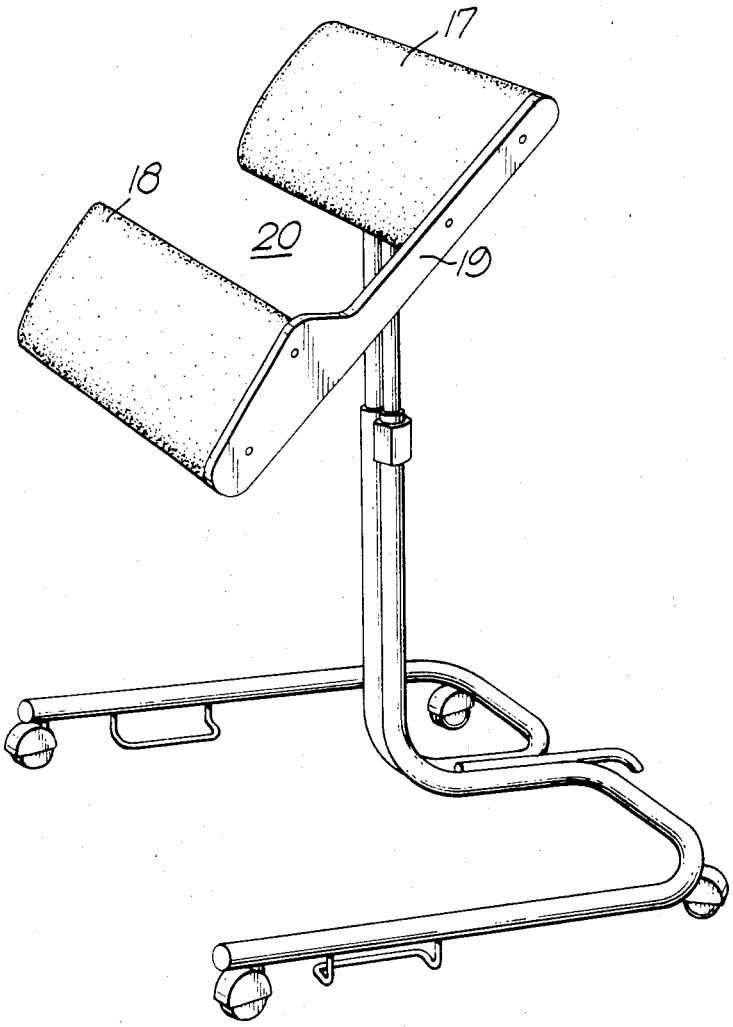
FIG. 11 is a sixth embodiment being a variant of the embodiment shown in FIGS. 8–10.

In FIG. 11, the posterior and thigh supporting means have been indicated by the reference numerals 17 and 18 respectively. They are connected by transversely disposed connecting member 19 which may be attached to the elements 17 and 18 by screws of other suitable means. The person to use the supporting device will have to enter sideways into the space 20.

Figure 12:
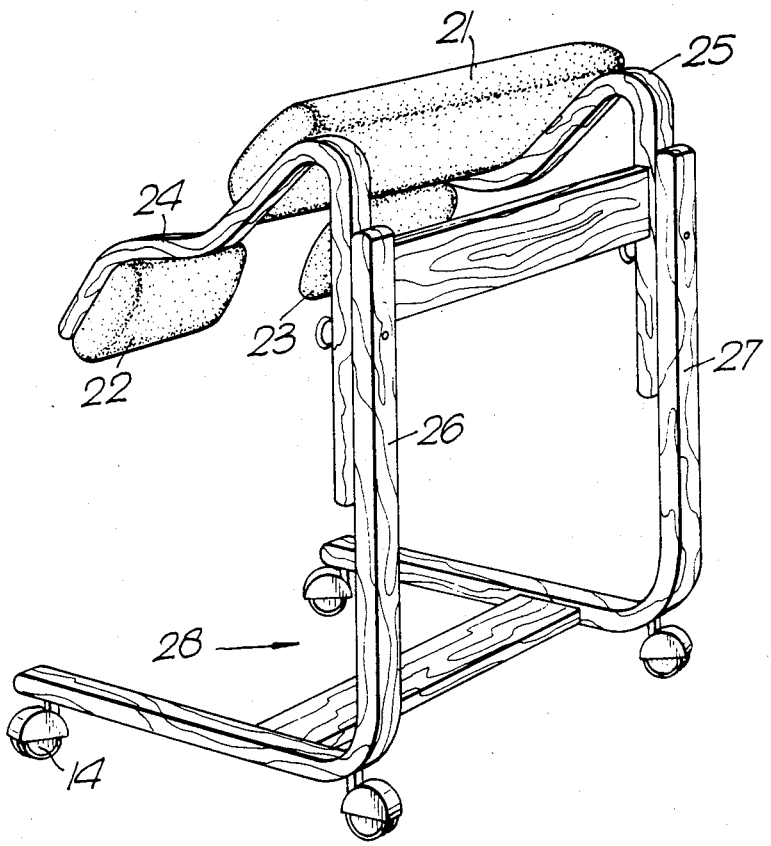
FIGS. 12, 13, 14 and 15 illustrate a seventh, eighth and ninth embodiment, respectively, particularly suited for legs and leg base made from wood.

The embodiment of FIG. 12 is in basic principle quite similar to that shown in FIG. 8, apart from some of the elements in FIG. 8 not being present in FIG. 12. The embodiment of FIG. 12 is suitably made from wood or laminated wood or a suitable plastics material. The supporting means 21 for the posterior is connected to the respective supporting means 22, 23 for the person's thighs by means of connecting members 24, 25 which at their respective rear ends extend downward and are connectable to respective uprights 26, 27, the latter at their respective bottom ends extending into a forwardly directed base 28 having casters 14. It is readily understood that the level of the supporting means 21, 22, 23 may be adjustable depending on the mutual position of the connecting members 24, 25 and the uprights 26, 27.

Figure 13:
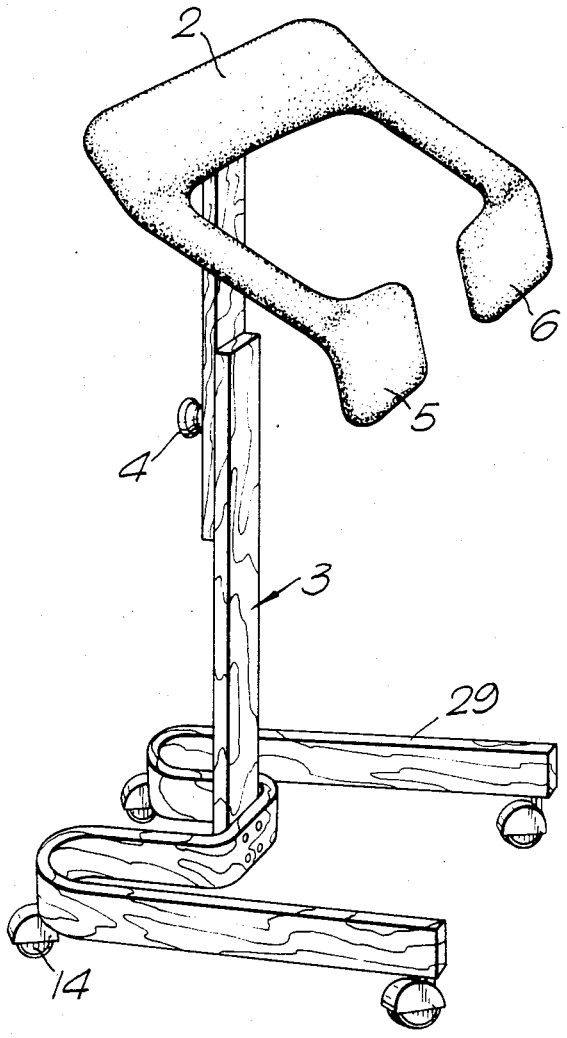

In FIG. 13 there is used a posterior and thigh supporting means similar to that shown in FIG. 1. The said supporting means 2, 5, 6 are in the embodiment shown supported by a single 2-piece leg 3, having adjustment means 4 for selectively adjusting the level of the supporting means 2, 5, 6. At its lower end the leg 3 is connected to a leg base 29. The base is provided with casters 14. The embodiment of FIG. 13 has suitably the leg 3 and the leg base 29 made from wood or laminated wood, although it is understood that any suitable material may be used.

Figure 14:
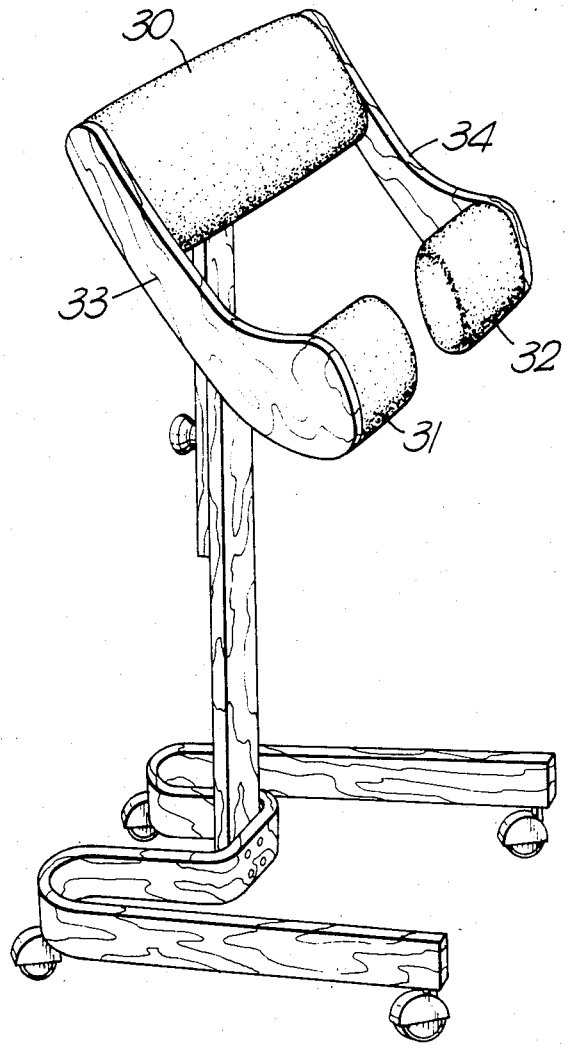
Figure 15:
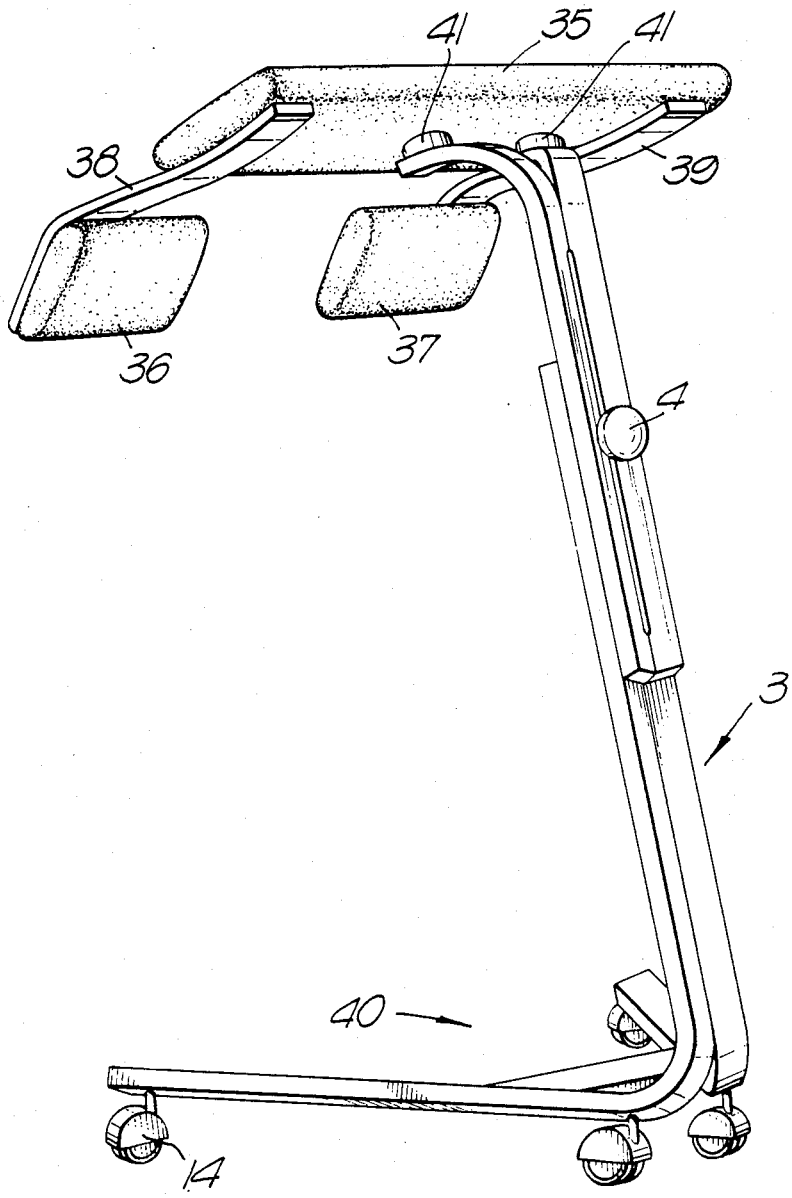
Figure 16:
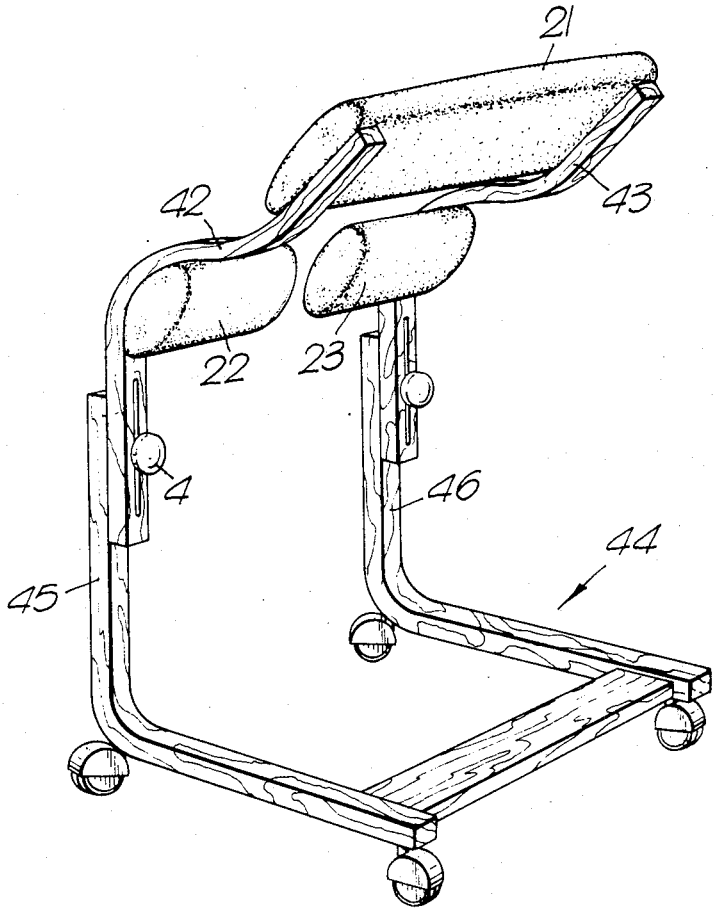
FIG. 16 is a tenth embodiment representing a modification of the embodiment in FIG. 12.

FIG. 14 is a slight modification of the embodiment of FIG. 13. In FIG. 13 as well as in several of the previously described figures, it was noted that the thigh supporting means 5, 6 are integral with the posterior supporting means 2. However, as seen in FIG. 14 where it is desirable to use wood as the major material, there are provided a posterior supporting means 30 and thigh supporting means 31, 32. The thigh supporting means are each connected to the posterior supporting means 30 by a connecting member 33, 34 respectively. FIG. 15 is another modification of the supporting device according to the invention. The level adjustment can be made exactly as in FIG. 13. It is noted that the leg 3 is slightly inclined, which is a preferred, but not limitating feature. The posterior supporting means 35 is connected to the thigh supporting means 36, 37 by means of individual connecting members 38, 39. In order to let the supporting means 35, 36, 37 be somewhat resilient relative to the leg and leg base 40, there may be provided resilient means 41 at the connected between the leg 3 and the posterior supporting means 35. These resilient elements 41 may be in the form of rubber blocks or the like. As seen in FIG. 15, the supporting device is provided with casters 14. The embodiment of FIG. 16 is more or less identical to the embodiment of FIG. 12 except for the fact that the connecting members 42, 43 are not connected to the base 44 at the rear portion thereof, but instead to the front portion thereof at the uprights 45, 46 respectively. Thus, the connecting members 42, 43 extend downwards from the supporting means 22, 23 and may be selectively, as regards level, connected to the uprights 45, 46 by means of adjustment means 4.

Figure 17:
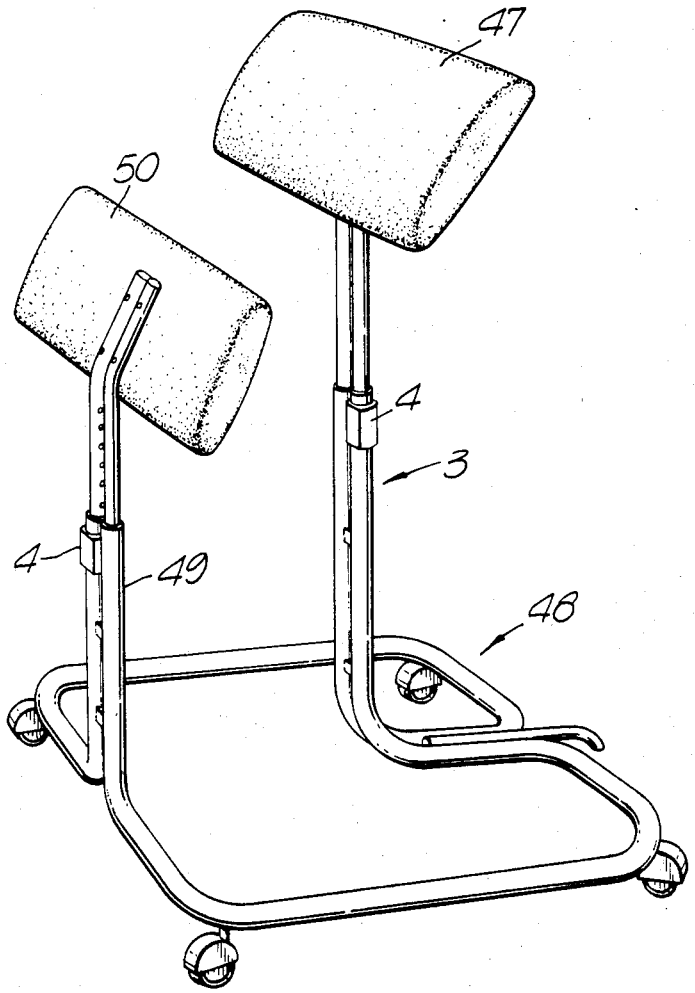
FIG. 17 is an eleventh embodiment of the supporting device according to the invention.

In the final illustrative figure, FIG. 17, it is noted that the posterior supporting means 47 is connected to a leg 3 similar to the embodiment in FIG. 11, the leg 3 extending into a leg base 48 at the rear end thereof. At the front end of the leg base, there is a further upright or leg 49 which at its upper end is terminated in a thigh supporting member 50. As clearly seen from FIG. 17, it is possible to adjust the level of both the posterior supporting means 47 and the thigh supporting member 50, e.g. by letting the legs 3, 49 be of the telescopic kind and having adjustment means 4 for selectively locating the supporting means 47, 50 at their required levels.

The posterior and thigh supporting means can be made in any suitable manner, e.g. by conventional upholstering technique or simply by letting the said means be made from so-called integral plastic foam. The latter choice of material may be particularly suitable in connection with the supporting devices shown in FIGS. 1–10 and 13, where the supporting means for the posterior and thighs can be made as a single unitary supporting means. If required, reinforcement may be embedded into such a unit.

Although the embodiments according to FIGS. 1, 8, 12, 16 and 17 are considered to be the preferred ones, it will be readily understood that a number of variants are still possible within the scope of the invention.

I claim:

1. A supporting device for a person comprising:

posterior support means forming a supporting surface for supporting the posterior of a person, thigh engaging means for engaging the front portion of both thighs of a person with portions thereof, said portions being spaced apart so as to define a forward free space therebetween which extends from the front of the device to the posterior support and into which a person can enter from the front of the device to utilize the device, connection means for positioning said thigh engaging means forwardly of said supporting surface; and holding means on one of said posterior supporting surface and thigh engaging means for maintaining said supporting device above a base surface.

2. A supporting device as in claim 1 wherein said holding means comprises at least one leg depending downward from said posterior supporting surface for contacting the base surface.

3. A supporting device as in claim 2 wherein said at least one leg is of the extendable telescopic type.

4. A supporting device as in claim 2 wherein said at least one leg has an upwardly turned lower end.

5. A supporting device as in claim 2 further comprising a generally horizontal leg base to which said at least one leg is attached, said base adapted for resting on the base surface.

6. A supporting device as in claim 5 further comprising casters attached to said base.

7. A supporting device as in claim 6 further comprising foot supports attached to said leg base which when downwardly loaded immobilize the base relative to the base surface.

8. A supporting device as in claim 1 wherein said holding means comprise means attached to said posterior supporting surface for connecting said posterior surface to a member raised off the base surface.

9. A supporting device as in claim 1 wherein each of said posterior support means, said thigh engaging means, and connections means comprise means forming a one-piece structure.

10. A supporting device as in claim 1 wherein said thigh engaging means comprise two members which extend forwardly from the front of said posterior supporting surface, and each having a part adapted to engage the front portion of a respective thigh, said parts being spaced sufficient far apart such that a person can move into the space between the posterior supporting surface and the thigh engaging means.

11. A supporting device as in claim 10 wherein said thigh engaging parts are slanted downwardly from said posterior engaging surface and the thighs engage the inside faces of said parts.

12. A supporting device as in claim 10 wherein said holding means comprises a leg extending downwardly from each said part of said thigh engaging means to a generally horizontal base member which contacts the base surface.

13. A supporting device as in claim 1 wherein said holding means comprises at least one leg depending downwardly from said thigh engaging means.

* * * * *